US005493384A

United States Patent [19]

Matsuno et al.

[11] Patent Number: 5,493,384

[45] Date of Patent: Feb. 20, 1996

[54] COLOR ELECTRO-PHOTOGRAPHIC APPARATUS WITH ENDLESS-BELT-SHAPED PHOTOSENSITIVE MEMBER

[75] Inventors: Junichi Matsuno, Tsuchiura; Masaru Nakano, Tsukuba; Tetsuro Akasaki, Katsuta; Tomio Hayano, Hitachi; Shoji Ukei, Hitachi; Hiroyuki Tadokoro, Hitachi, all of Japan

[73] Assignee: Hitachi, Ltd., Tokyo, Japan

[21] Appl. No.: 227,336

[22] Filed: Apr. 14, 1994

[30] Foreign Application Priority Data

Apr. 14, 1993 [JP] Japan ..... 5-087081
Jul. 30, 1993 [JP] Japan ..... 5-189612

[51] Int. Cl.[6] ..... G03G 15/01

[52] U.S. Cl. ..... 355/326 R; 355/208; 355/212; 355/271; 355/317

[58] Field of Search ..... 355/200, 210, 355/208, 309, 308, 317, 326 R, 327, 271, 272, 277, 211, 212

[56] References Cited

U.S. PATENT DOCUMENTS 4,126,388 11/1978 Kawai ..... 355/217
4,609,281 9/1986 Miyai et al. ..... 355/210
4,788,572 11/1988 Slayton et al. ..... 355/317
4,899,196 2/1990 Mahoney ..... 355/271
5,049,946 9/1991 Harada ..... 355/309
5,084,735 1/1992 Rimai et al. ..... 355/271
5,122,842 6/1992 Rimai et al. ..... 355/326 R
5,140,379 8/1992 Johnson ..... 355/317
5,177,543 1/1993 Rodenberg et al. ..... 355/271
5,247,337 9/1993 Malachowski ..... 355/308
5,258,816 11/1993 Haneda ..... 355/210 X

*Primary Examiner*—Sandra L. Brase
*Attorney, Agent, or Firm*—Antonelli, Terry, Stout & Kraus

[57] ABSTRACT

The present invention relates to a desk-top type color electro-photographic apparatus which is easy in use, small in size and light in weight, wherein maintenance such as changing its photosensitive member can be performed by a user and color adjustment is performed with high accuracy of less than 100 μm. Developing units for four colors are placed in a rank, a single endless-belt-shaped photosensitive member being placed below them to form an approximately oval shape, the photosensitive member being touched with a transfer member on its major axis side to transfer each color of images. In addition to this, the photosensitive member is employed a cartridge type for easiness of user's maintenance and constructed such that highly accurate positioning between the body of apparatus and the cartridge can be performed. Effect of the eccentricity of pulleys is decreased by means of making the pulleys wrapped with the photosensitive member have the identical diameter and making the diameter of the transfer member integer times as large as that of the pulley.

11 Claims, 14 Drawing Sheets

$$\text{BLACKENING RATE} = \frac{\text{AREA OCCUPIED BY TONER IMAGE}}{\text{AREA OF PAPER}} \times 100\ (\%)$$

COLOR ELECTRO-PHOTOGRAPHIC APPARATUS WITH ENDLESS-BELT-SHAPED PHOTOSENSITIVE MEMBER

BACKGROUND OF THE INVENTION

1. Field of the Invention

The present invention relates to a color electro-photographic apparatus, and more particularly to a desk-top type small size laser printer.

2. Description of the Prior Art

In the prior art concerning the apparatus, as described in, for example, Japanese Patent Application Laid-Open No. 3-106736 (1991) and Japanese Utility Model Application Laid-Open No. 3-77941 (1991), photosensitive drums for four colors are individually placed in a single line in the lateral direction, an endless intermediate transfer belt being provided such as to touch with the bottom parts of the photosensitive drums.

In the apparatus described above, driving of the photosensitive drums and the intermediate transfer belt is performed by driving all of the photosensitive drums and the intermediate transfer belt using a single drive unit or by driving them individually using independent drive units.

Developing means for four colors are placed in a rank under a single photosensitive member being endless-belt-shaped to superpose four color toner images on the photosensitive member, as described in Japanese Patent Application Laid-Open No. 4-326373 (1992).

In the apparatus described in Japanese Patent Application cartridge as to be easily mounted and dismounted by the users.

On the other hand, in the color electro-photographic apparatus where developing means for four colors are individually placed in a single line in the lateral direction, an endless-belt-shaped photosensitive member being touched with an intermediate transfer member on a cylinder, a color image being obtained by means of superposing each of color images on the transfer member; the accuracy in color adjustment is required to be approximately below 100 μm, and in order to realize this accuracy the average accuracy is required to be below 60 μm.

It has not been realized the apparatus in which the market needs such a usability is compatible with the basic specification of color electro-photography.

In order to realize a disk-top small sized color laser printer, it is desirable for small size and low cost to realize a so called one motor type apparatus in which a transfer member on a cylinder is driven by an endless-belt-shaped photosensitive member. However, there are disadvantages that there appears the displacement in colors due to the difference between the thermal expansion of the drive pulley rotating the photosensitive member and the thermal expansion of the transfer member, the displacement in colors by the change in transferring speed ratio from the photosensitive member to the transfer member due to change in the thickness of toner layer or the effect of toner overlaying caused by developing condition change due to deterioration with age or change in temperature.

Objects of the present invention are to solve the problems described above, and to provide a color electro-photographic apparatus which is small in size and light in weight, being capable of performing its maintenance by a user himself, producing a high quality picture by means of highly accurate color adjustment.

In order to attain the above objects, the construction to realize a high quality picture by means of superposing once each color of toner images on an intermediate transfer member is constructed such that developing means for four colors are placed in a rank above a single endless-belt-shaped photosensitive member, each color of toner images on the photosensitive member is touched with a photosensitive member formed in an approximately oval on its major axis side to transfer the image.

In addition to this, the photosensitive member is employed a cartridge type for easiness of user's maintenance and for capability of highly accurate positioning between the body of apparatus and the photosensitive member cartridge when a user changes the photosensitive member.

The following are embodiments of a color electro-photographic apparatus according to the present invention.

A color electro-photographic apparatus having a photosensitive member for forming an electro-static latent images on it by exposure, a plurality of developing means for forming toner images from the electro-static latent images formed on the photosensitive member by exposure, a transfer member for transferring the toner images on it, wherein the photosensitive member is endless-belt-shaped, the transfer member being drum-shaped. And a plurality of the developing means are placed in a single rank.

Further, a color electro-photographic apparatus having an endless-belt-shaped photosensitive member for forming an electro-static latent images on it by exposure, developing means for forming toner images from the electro-static latent images formed on the photosensitive member, a transfer member for transferring the toner images on it by touching with a part of the photosensitive member, wherein a plurality of the developing means are placed in a single rank, the endless-belt-shaped photosensitive member being laterally stretched to form approximately an oval shape such as to touch with each of the developing means, the endless belt and the transfer member being placed laterally such that the edge surface in the major axis side of the endless belt touches with the transfer member.

SUMMARY OF THE INVENTION

In the color electro-photographic apparatus where each of toner images on a photographic member is transferred on a transfer member one after another, the positional accuracy between the photosensitive member and the transfer member after assembling the whole apparatus is required to be below 50 μm. On addition to this, the accuracy has to be always kept even after a user dismounts and mounts a photographic member cartridge.

Further, since the body of apparatus is manufactured to be small in size, light in weight and low in cost, there are some cases where bending or torsion exceeding the required color adjustment accuracy appears due to the effect of flatness of a desk on which the apparatus is placed. Such a product cannot be a user maintainable product.

In the construction described above, four of the developing means may be provided for the four colors. The endless-belt-shaped photosensitive member may be stretched with wrapping more than three pulleys. Further, the endless-belt-shaped photosensitive member stretching with wrapping more than three pulleys is formed in a cartridge, and the cartridge may be easily mount or dismount on the color electro-photographic apparatus from the direction parallel to a plane approximately parallel to the installation direction of the apparatus.

A drive pulley for driving the endless-belt-shaped photosensitive member among more than three of the pulleys wrapped with the endless-belt-shaped photosensitive member may be rotatably supported with sufficient rigidity, and one of the pulleys except the pulley giving tension to the endless-belt-shaped photosensitive member may be rotatably and two-dimensionally supported with the apparatus.

A loading means for giving pressure to both of or either of the drive pulley and the pulley rotatably and two-dimensionally supported with the apparatus in the direction of pulley shaft may be provided.

The whole surfaces of the pulley giving tension to the endless-belt-shaped photosensitive member may be covered with a material softer than the base material of the endless belt, or the material may be rubber. The surface of the drive pulley may have a rubber layer and the thickness of the layer may be thinner than 2 mm.

Further, the following are other embodiments of a color electro-photographic apparatus according to the present invention.

A color electro-photographic apparatus having an endless-belt-shaped photosensitive member for forming an electro-static latent images on it by exposure, developing means for forming toner images from the electro-static latent images formed on the photosensitive member, a transfer member for transferring the toner images, wherein the endless-belt-shaped photosensitive member being laterally stretched to form approximately an oval shape such as to touch with each of the developing means, the endless belt and the transfer member being placed laterally such that the edge surface in the major axis side of the endless belt touches with the transfer member, the endless-belt-shaped photosensitive member being stretched with wrapping more than three pulleys, all the pulleys except the pulley giving tension to the endless-belt-shaped photosensitive member having an identical outer diameter, the outer diameter being an integer ratio of the diameter of the transfer member and having an accuracy less than 0.5%.

In the construction, a plurality of developing means may be provided and placed in a single rank, and the endless-belt-shaped photosensitive member may be placed under the plural developing means.

Further, the object described above can be attained by providing a color electro-photographic apparatus having a endless-belt-shaped photosensitive member for forming an electro-static latent images on it by exposure, developing means for forming toner images from the electro-static latent images formed on the photosensitive member, a transfer member for transferring the toner images, wherein the developing means for four colors are individually placed in a single line in the lateral direction, the color electro-photographic apparatus further comprising means for measuring the one rotation time of the transfer member when the toner image on the transfer member is transferred, comparing means for comparing the one rotation time of the transfer member with the base time between electrostatic latent images for individual color image printed on the photosensitive belt, and registration control means for controlling the moving speed of the photosensitive member during printing the electrostatic latent images on the photosensitive member based on the output of the comparing means.

As a further embodiment, three legs are provided on the bottom of a color electro-photographic apparatus having the construction described above to set the apparatus on a desk. The height of the body of apparatus is less than 370 mm. And the weight of the apparatus is less than 50 kg.

By using the means described above, the photosensitive member cartridge can be positioned at a specified position by being pushed with a certain pressure. The effect of eccentricity of the pulleys can be decreased by means of making the pulleys wrapped with the photosensitive member have the identical diameter and making the diameter of the transfer member integer times as large as that of the pulley.

Since the positioning of the photosensitive member cartridge is performed with the minimum necessary portions, that is, the drive pulley directly receiving external force and a point other else, the photosensitive member has such a construction that the cartridge follows the accuracy of the body of apparatus even when the mechanical accuracy of the cartridge is not sufficient.

Further, the bottom surface of the apparatus can be kept flat and the deformation of the apparatus can be suppressed by means of installing the apparatus with three legs even when the body of apparatus is forced to be distorted during user's maintenance.

The registration control means measures the one rotation time of the transfer member when a first color toner image is transcribed on the transfer member, comparing the one rotation time of the transfer member with the base time, controlling the moving speed of the photosensitive member printing the imaged electrostatic latent image on the photosensitive member for a first color in the next page.

And the registration control means measures the one rotation time of the transfer member during transfer a first color toner image to the transfer member, and controls the moving speed of the photosensitive member during printing electrostatic latent images for all the color of or for the combination among a second, a third and a fourth colors on the photosensitive member.

With the actions described above, the following construction can be employed. Therein, developing means for four colors are individually placed in a single line in the lateral direction, a endless-belt-shaped photosensitive member being touched with the developing means, the endless belt and the cylindrical transfer member being placed side by side such that the major axis of the endless belt is touched with the transfer member, which realizes a disk-top type color electro-photographic apparatus capable of performing color adjustment with high accuracy.

DETAILED DESCRIPTION OF THE PREFERRED EMBODIMENTS

An embodiment according to the present invention will be described below, referring to FIG. 1 to FIG. 11.

Figure 1:
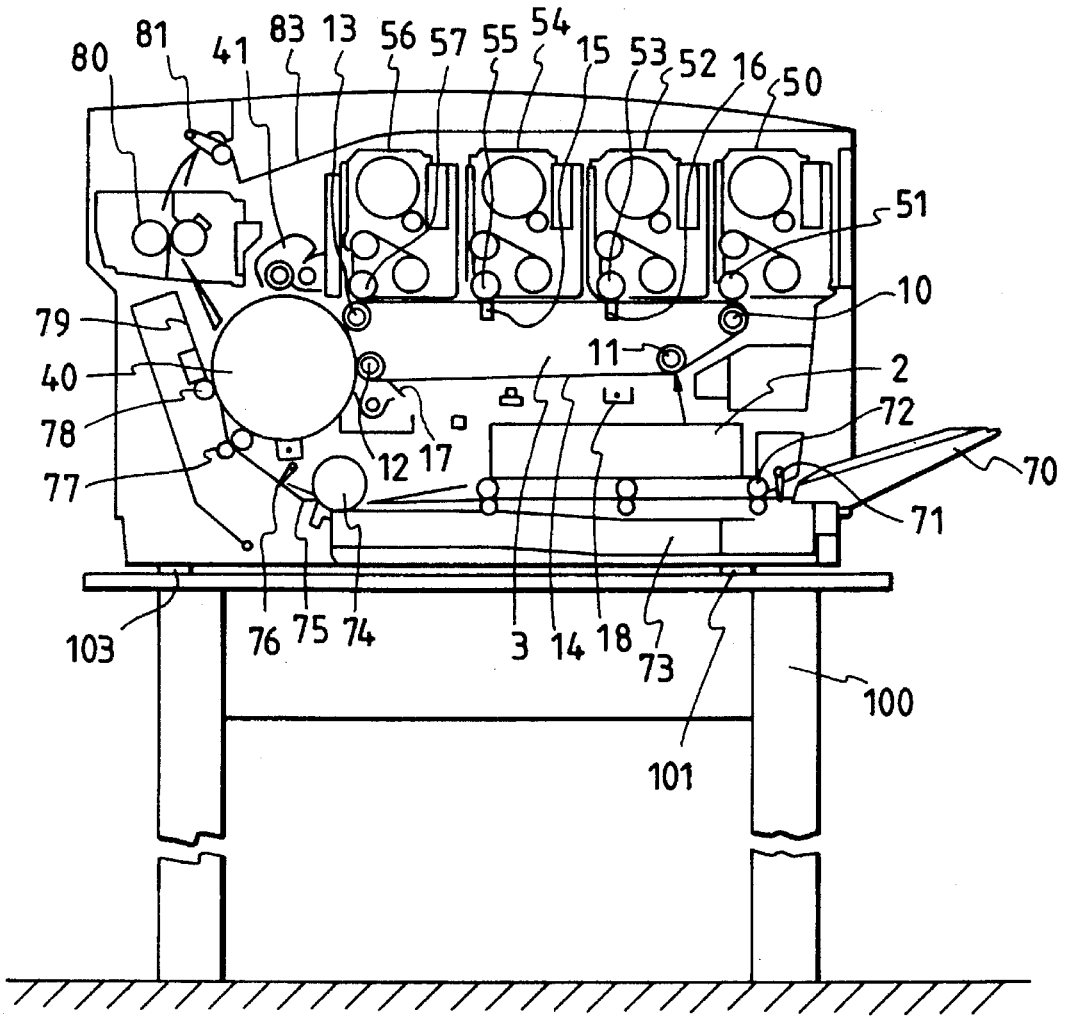
FIG. 1 is a schematic cross-sectional view showing the installation state of a color electro-photographic apparatus according to the present invention.

FIG. 1 is a disk-top type color electro-photographic apparatus 1 according to the present invention installed on a desk. The main body of the apparatus 1 is installed on a desk 100 in a room supported with a front leg 101, a rear leg and a leg 103 which is not shown because it is behind the front leg 101. These legs are provided on the bottom of the main body of the apparatus.

The color electro-photographic apparatus comprises an endless-belt-shaped photosensitive member 14 for forming an electrostatic latent image on it by a laser beam irradiated in the arrow direction from an exposure unit 2, developing units for forming toner images from the electrostatic latent images formed on the photosensitive member composed of a yellow developing unit 50, a magenta developing unit 52, a cyanic developing unit 54 and a black developing unit 56 which are laterally arranged in a single line, and a cylindrical transfer drum 40.

Each of the developing units arranged in a rank is placed above the photosensitive member 14, the photosensitive member 14 being laterally stretched to form an approximately oval shape such as to touch with each of the developing units as shown in FIG. 1.

The photosensitive member 14 is constructed in a cartridge 3 which wraps four pulleys and can be mounted or dismounted as a unit. The pulleys are composed of a drive pulley 10 for driving the photosensitive member 14, a pulley A 11 for limiting the exposure position, a pulley B 12 for keeping the contacting width of the transfer drum 40 and the photosensitive member 14, and a tension pulley 13 for giving an initial tension to the photosensitive member 14. Each of the pulleys is rotatably supported with side plates 31, 31' (refer to FIG. 2) of the cartridge 3.

Developing process will be described below. Firstly, the photosensitive member 14 is charged uniformly with a charger A 18 to form an electro-static latent image for yellow color by irradiating a laser beam on the photosensitive member 14 in the direction of the arrow indicated in the figure with the exposure unit 2.

The electrostatic latent image for yellow color is formed into a toner image in yellow color with the yellow developing unit 50, and the toner image-in yellow color is transferred to the contact part of the transfer drum 40 and the photosensitive member 14. In this time, the magenta developing unit 52, the cyanic developing unit 54 and the black developing unit 56 are kept apart from the photosensitive member 14. The toner image in yellow color is transferred to the transfer drum 40. After transference, the yellow toner remaining on the photosensitive member 14 is cleaned with a blade cleaner 17.

Then, a magenta, a cyanic and a black images are superposed on the transfer drum 40 in the same process to form a color image.

During developing, the gap (for example, 0.4 mm) between the photosensitive member 14 and a yellow mag roll 51, a magenta mag roll 53, a cyanic mag roll 55 or a black mag roll 57 needs to be kept in high accuracy. Especially, in the construction where an endless belt is used as the photosensitive member 14, it is difficult to maintain and control the gap. In order to keep the gap in high accuracy, according to the present invention, the gap between the yellow mag roll 51 and the photosensitive member 14 is controlled with the yellow mag roll 51 and the drive pulley 10 facing to the yellow mag roll 51, the gap between the magenta mag roll 53 or the cyanic mag roll 55 and the photosensitive member 14 being controlled with the magenta mag roll 53 or the cyanic mag roll 55 and a stay A 16 or a stay B 15 placed in a position facing to the magenta mag roll 53 or the cyanic mag roll 55 through the belt, the gap between the black mag roll 57 and the photosensitive member 14 being controlled with the black mag roll 57 and the tension pulley 13. With individually controlling the gap for each color, keeping high accuracy can be realized.

Sheets of paper are stored in a tray 73 or provided from a manipulative tray 70. The sheets of paper in the tray 73 are transferred with a paper feeding roller 74 one by one and guided with a paper feeding guide 75. The paper feeding state for the paper is watched by detecting timing of a detecting sensor A 76. On the other hand, the paper provided in the manipulative tray 70 is detected by a detecting sensor B 71 to start driving a paper feeding roller 72 and transferred up to the paper feeding roller 74.

Tilting of the paper is corrected by means of starting and stopping of a registration roller 77 using the timing of the detecting sensor A 76.

The paper after corrected its tilting is pressed to the transfer drum 40 by a transfer roller 78, and the toner image formed on the transfer drum 40 is transferred on the paper. the toner image may be mono-color, multi-color or full color depending on the kinds of colors to be transferred to the paper.

The paper after transferred the toner image is guided with a transfer guide 79 to a fixing unit 80. After the toner image being fixed on the paper with the fixing unit 80, a detecting sensor C 81 detects the paper to watch the transferring state of the paper. Then, the paper is released to a releasing tray 83 with a releasing roller.

After the toner image being transferred to the paper, the toner remaining on the transfer drum 40 is cleaned with a cleaner 41, and the processing steps to the next toner image transfer process for transferring from the photosensitive member 14 on the transfer drum 40.

Figure 2:
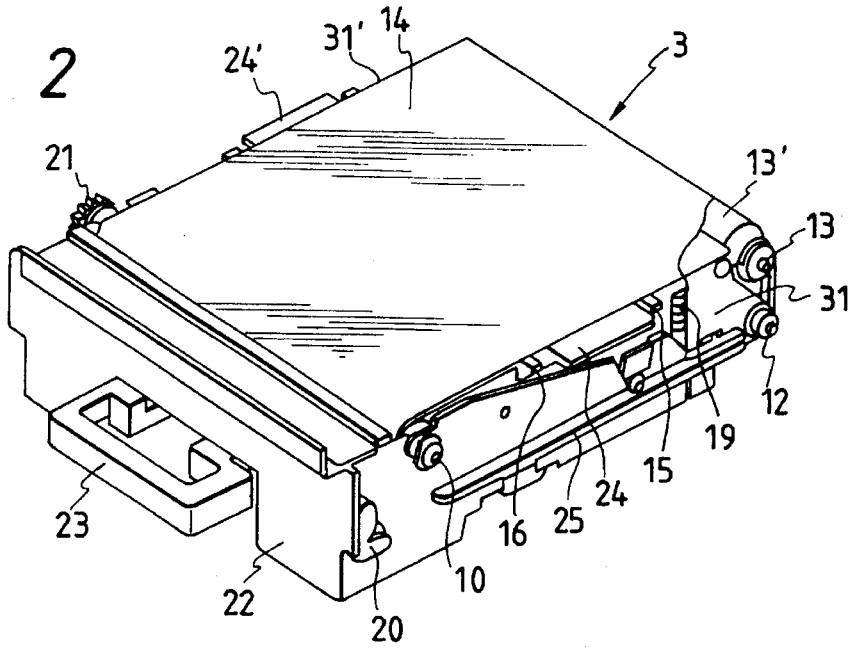
FIG. 2 is a perspective view of a photosensitive member cartridge.

The cartridge 3 having the photosensitive member 14 for such a color electro-photographic apparatus 1 is constructed such as to mount and dismount on the color electro-photographic apparatus 1 in order to realize user's maintenance shown in FIG. 2.

The cartridge 3 has handles 24, 24, on the both sides of the cartridge 3 in order to be carried by a user in ease. Further, in order to easily mount the cartridge 3 on the color electro-photographic apparatus 1, the cartridge 3 is fastened to a cartridge holder 22 having a holder guide rail 25. A handle 23 is provided in the cartridge holder 22, and the cartridge 3 is mounted on the color electro-photographic apparatus 1 shown in FIG. 1 with holding the handle 23. After mounting the cartridge 3, the handle 23 is turned downward, hooks 20 provided on the both end sides of a rotating shaft of the handle 23 engaging with pins 38, 38' (refer to FIG. 4) fixed on the side plates of the color electro-photographic apparatus 1, the cartridge 3 is fastened to the color electro-photographic apparatus 1 through the cartridge holder 22.

A gear 21 for transmitting driving force is provided on one end of the shaft of drive puller 10. In the embodiment, although a helical gear is used as the gear 21, other types of gears, for example, flat gear may be used. Both shaft ends of the tension pulley 13 are rotatably supported with links having the same center of rotation as the shaft of the pulley B 12. The links are pulled with sprigs 19 in the direction such as to act tension on the photosensitive member 14.

The width of the portion in the tension pulley 13 touching with the photosensitive member is a little shorter than the width of the photosensitive member 14, and the tension pulley has tapers at its end portions. When the photosensitive member 14 deviates, a rib (not shown) provided in each of the width sides on the inside surface of the photosensitive member 14 runs up on the shaft end portion of the tension pulley 13 and the photosensitive member tilts. With this tilting, the deviation of the photosensitive member 14 is corrected by the orbit of motion of the photosensitive member 14 and the tension pulley 13. In this occasion, a slip between the photosensitive member 14 and the tension pulley 13 might take place. In order to prevent the slip, the surface of the tension pulley is covered with a material 13' to increase the coefficient of friction. In the embodiment, rubber is used as the material.

The gap between the photosensitive member 14 and the mag roll for each color is controlled with the construction where the both side ends of the stay A 16 and the stay B 15 fixed to the cartridge side plates 31, 31' of the cartridge 3 contact to gap rings provided on the developing units for individual colors.

Figure 3:
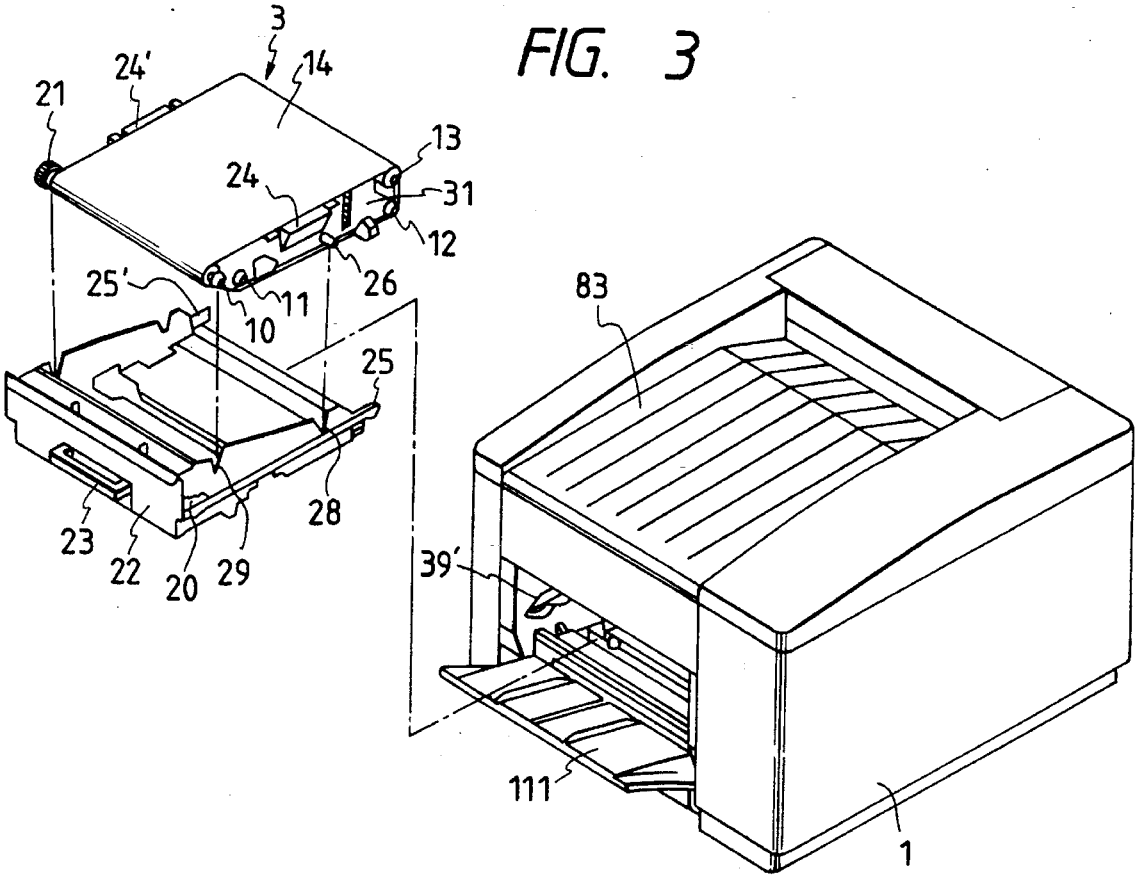
FIG. 3 is a perspective view illustrating mounting of a cartridge on an apparatus.

Mounting of a cartridge 3 on a color electro-photographic apparatus will be described, referring to FIG. 3.

The cartridge 3 is carried with holding the handles 24 and 24' to fasten it to the cartridge holder 22. In this occasion, projections 26 provided on the shaft ends of the pulley A 11 of the cartridge 3 and the center lower portion in the major axis of the cartridge 3 having an approximately oval shape are engaged with and fixed to concave portions 28 and 29 provided on the end surface portions in the mounting direction of the cartridge holder 22. The pulley A 11 is constructed such as to be rotatable under the condition that the shaft end portions are put in the concave portions 29. Further, an opening is provided on the bottom surface of the cartridge holder 22 so that the laser beam from the exposing unit 22 can irradiate the photosensitive member 14 in the cartridge 3.

Next, the cartridge holder 22 to which the cartridge 3 has been fixed is inserted into the color electro-photographic apparatus 1 through a mounting opening provided in the front thereof. The mounting opening exposed by opening a cartridge cover 111 to ready for mounting. The cartridge holder 22 is inserted into the color electro-photographic apparatus 1 while the holder guiding rails 25, 25' of the cartridge holder 22 are kept contacting with the guide rails 39, 39' provided in the color electro-photographic apparatus 1. When the cartridge 3 touches to a stopper provided in the color electro-photographic apparatus 1 and does not go into further, the handle 23 is turned downward to fix the cartridge by hooking the hooks 20 to the pins 38, 38' (refer to FIG. 4).

In order to high accuracy in the gap between the photosensitive member 14 and each of the mag rolls, that is, the mag rolls of the yellow developing unit 50, the magenta developing unit 52, the cyanic developing unit 54 and the black developing unit 56, when the photosensitive member 14 is mounted on the color electro-photographic apparatus 1, the magenta mag roll 53 is positioned by following the stay B 15, the cyanic mag roll 55 being positioned by following the stay A 16, the yellow mag roll 51 being positioned by following the drive pulley, the black mag roll 57 being positioned by following the tension pulley 13 (refer to FIG. 2).

The feature of the cartridge 3 guided to be mounted to the color electro-photographic apparatus 1 will be described in detail, referring to FIG. 4 to FIG. 6.

Figure 4:
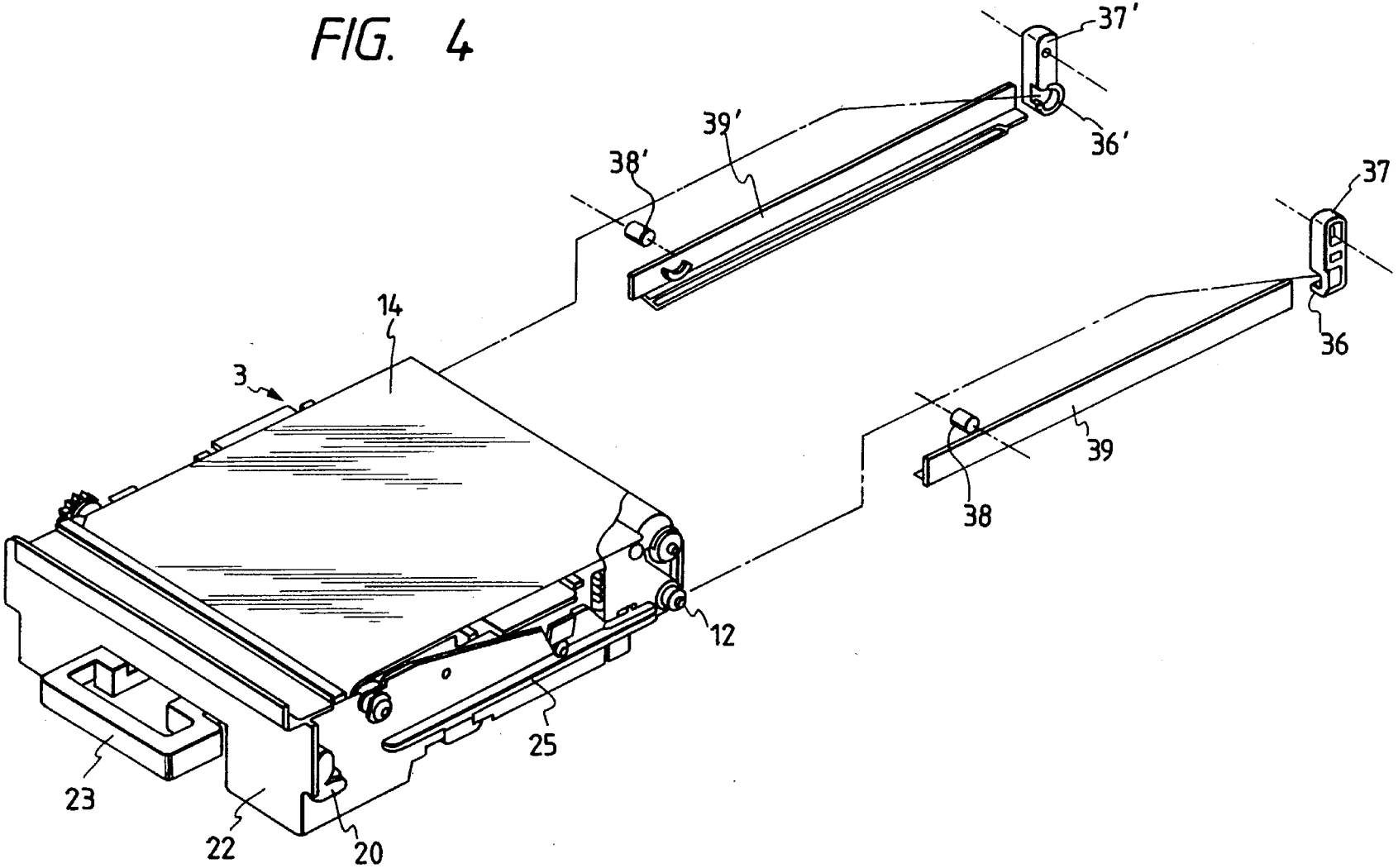
FIG. 4 is a perspective view illustrating guiding means during mounting a cartridge.
Figure 5:
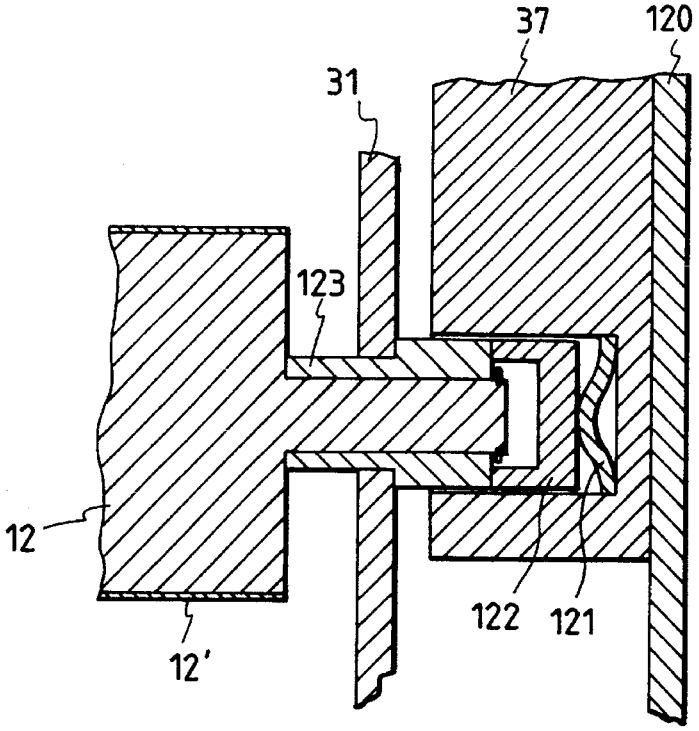
FIG. 5 is a cross-sectional view of the pressing mechanism part in the holder B.

FIG. 4 shows guiding means for the cartridge 3. The cartridge 3 is fixed to the cartridge holder 22, the handle 23 being turned upward. The portion of the hook 20 connecting to the apparatus side is positioned in the lateral direction as shown in the figure.

Among the parts in the mounting portion of the color electro-photographic apparatus 1, only the parts required for fixing the cartridge 3 are shown in FIG. 4. The chain line indicates the portion supporting the pulley B 12. The pins 38, 38' hooked by the hooks 20 are fixed to both of the side plates of the color photographic apparatus 1. Further, the guide rails 39, 39' and the holders B 37, 37' supporting the pulley B 12 are also fixed to both of the side plates of the color electro-photographic apparatus 1 using screws or by press fitting or adhesion.

The cartridge holder 22 incorporated with the cartridge 3 is inserted into the color electro-photographic apparatus 1 while the holder guiding rails 25, 25' of the cartridge holder 22 are kept contacting with the guide rails 39, 39' provided from the mounting opening in the color electro-photographic apparatus 1. When the both ends of the pulley B 12 enter into fixed portions 36, 36' of holders B 37, 37' to be stopped. Then, the handle 23 is turned downward to fix the cartridge 3 to the color electro-photographic apparatus 1 by hooking the hooks 20 to the pins 38, 38'.

The mounting mechanism to realize an accurate positioning when the pulley B 12 is entered in the holders B 37, 37' will be described in detail, referring to FIG. 5.

The holder B 37 is fixed to the side plate 120 of the color electro-photographic apparatus 1. The outer surface of the pulley B 12 is covered with a rubber material 12' of soft materials to protect the photosensitive member 14. The both side end of the pulley B 12 are rotatably supported with the cartridge side plate 31 of the cartridge 3 using a sliding bearing 123. The positioning is performed by means of restricting the sliding bearing 123 in two-dimensional, vertical and lateral, with the holder B 37.

A waving washer 121 is entered between the sliding bearing 123 and the holder B 37 through a top 122 to press the sliding bearing 123, the cartridge side plate 31 and the pulley B 12 being pressed toward the holder B 37' fixed to the side plate on the opposite side of the color electro-photographic apparatus 1 to preform positioning. A leaf spring or a coil spring may be used instead of the waving washer 121. Therewith, the positioning of the cartridge 3 and the pulley B 12 can be performed, and then the position of the photosensitive member 14 in the moving direction and in the vertical direction is determined.

Figure 6:
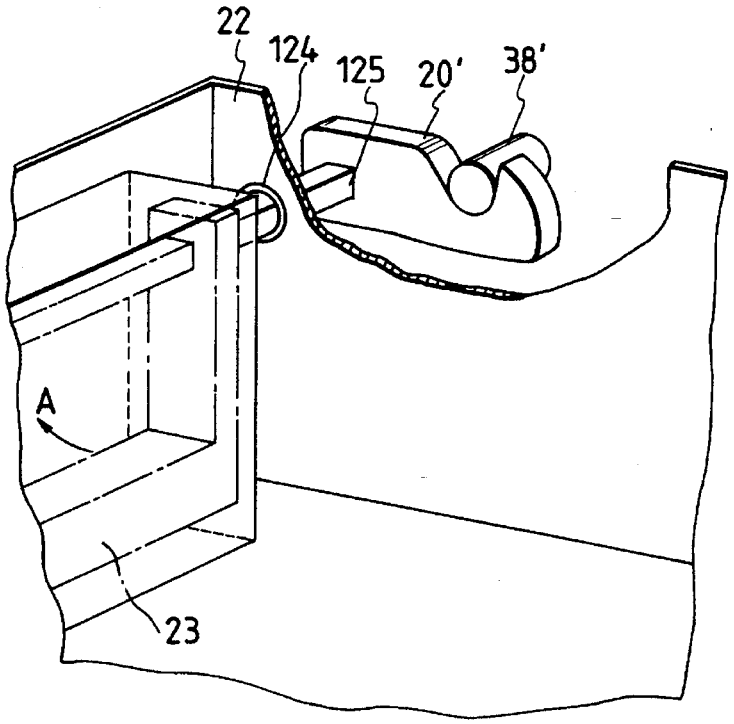
FIG. 6 is a perspective view of a pressing mechanism for the direction of the cartridge insertion.

FIG. 6 shows the outline of the positioning in the direction of cartridge 3 insertion. The handle 23 is attached to a quadratic prism shaft 125 rotatably supported with the cartridge holder 22 having the cartridge 3. The quadratic prism shaft 125 is rotated with rotation of the handle 23 and is rotatably supported with a quadratic prism bearing 124 attached to the side plate of the cartridge holder 22.

The hooks 20, 20' are provided on the both shaft ends of the quadratic prism shaft 125, and the hooks 20, 20' rotate the same angle as the handle 23. When the handle 23 rotates in the direction indicated the arrow A, the hook 20' releases the pin 38' provided on the side plate of the color electro-photographic apparats 1. To the contrary, when the handle 23 is turned downward in the reverse direction of the arrow, the hook 20' hooks the pin 38'.

As the handle 23 is turned so sufficient that the hook 20' surely hooks the pin 38', the force to pull the pin 38' is caused by the bend spring resistance produced in the portion of the quadratic prism shaft between the side plate of the cartridge holder 22 and the hook 20'.

By this force, the cartridge holder 22 and the cartridge 3 are pushed and moved toward the transfer drum 40, the shaft of the drive pulley 10 being surely touched to the stopper provided in the side plate of the color electro-photographic apparatus 1, thus the accurate positioning can be attained. The same relationship between the hook 20' and the pin 38' can be also applied to the construction in the opposite side of the illustration in the figure.

With employing the construction described above, the cartridge is easily and accurately positioned even when a user mounts the cartridge in the apparatus.

Figure 7:
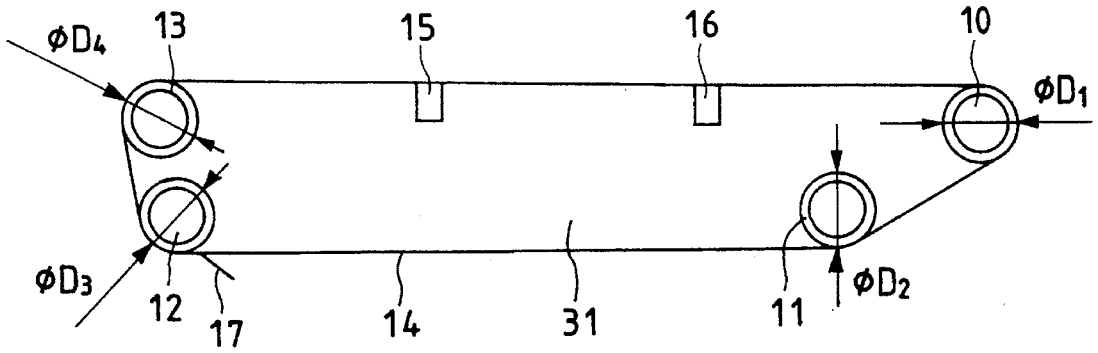
FIG. 7 is a side view showing the configuration of the individual pulley in a cartridge and the photosensitive member.

The relationship between the photosensitive member 14 and the pulleys composing the cartridge 3 will be described below, referring to FIG. 7.

The diameter D1 of the drive pulley 10, the diameter D2 of the pulley A 11 and the diameter D3 of the pulley B 12 are made identical. These pulleys are rotatably supported with the cartridge side plates 31. Each of the diameters of the pulleys is the value after it is coated with rubber or the like. The diameter D4 of the tension pulley 13 may be different from those of the other pulleys. The diameter of the transfer dram 40 contacting to the photosensitive member 14 is approximately integer times as large as the diameter D1 of the drive pulley 10, the diameter D2 of the pulley A 11 or the diameter D3 of the pulley B 12.

When the outer diameter of the transfer drum is 110 mm, the diameter D1 of the drive pulley 10, the diameter D2 of the pulley A 11 or the diameter D3 of the pulley B 12 are chosen to be an integer ratio of the diameter of the transfer drum and having an accuracy less than 0.5%. Supposing the eccentricity of each pulley is 50 μm, the integer ratio being approximately ¼, the unevenness of pixel pitch, which is caused by the positional difference between the contacting positions the transfer drum 40 and each of the pulleys due to the margin of error in the integer ratio, being less than 2 μm, the common difference of the diameter of each pulley is calculated to be 0.1%. However, as a result of investigation, it is revealed that the unevenness of pixel pitch is within a level where it cannot be visually confirmed as far as the common difference of the diameter is less than 0.5% under the condition described above.

Figure 8:
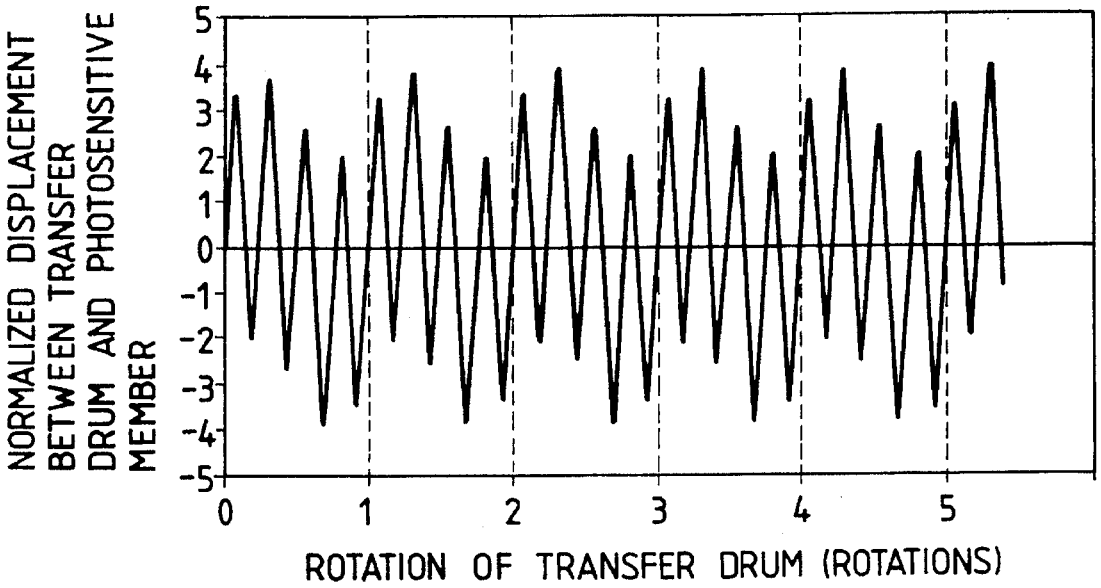
FIG. 8 is a graph showing the measured results of the positional displacement between the transfer drum and the photosensitive member.

FIG. 8 shows a measured result of the displacement between the transfer drum 40 and the photosensitive member 14. The non-dimensional displacement between the transfer drum 40 and the photosensitive member 14 due to the speed change in the photosensitive member 14 is shown in the vertical axis when each of the eccentricities in the drive pulley 10, the pulley A 11 and the pulley B 12 is normalized in 1 (one) and the transfer drum 40 is rotated at a constant speed. In the case where there is the eccentricity of 50 μm in each of the driving pulley 10, the pulley A 11 and the pulley B 12, the displacement in the absolute coordinate is derived as 200 μm at maximum from four times of 50 μm. However, by employing the construction shown in the embodiment, the displacement changes with the same pattern in each of colors, that is, in each rotation of the transfer drum 40, which does not produce the relative displacements in colors.

According to the construction, the transfer drum rotates once with four rotations of each pulley. Therefore, since the displacement between the transfer drum 40 and the photosensitive member 14 appears with the same pattern in each rotation of the transfer drum 40 as shown in FIG. 8 even when each of the pulleys has its eccentricity, the displacement in colors does not appear. The margin of error appears in the absolute positions of pixels, but it is not noticeable. Therefore, the manufacturing common difference in each of the pulleys and the transfer drum 40 can be extended up to the applicable range.

In order to assure the performance above, the shafts of the transfer drum 40, the drive pulley 10, the pulley A 11 and the pulley B 12 are required to be parallel each other. However, it is important from the point of practical use of the present invention how far the deformation caused by the common difference of machining and the deformation caused by installing the color electro-photographic apparatus 1 on a table having unevenness are allowable. One of the countermeasure is to reinforce the strength of the body of apparatus. However, the color electro-photographic apparatus 1 is characterized by desk-top and small size, and is different from a floor stand type color electro-photographic apparatus that has been in commercial use. The important thing for the color electro-photographic apparatus is how the accuracy in the body of apparatus can be kept with a soft structure.

Legs provided on the bottom plate of the body of apparatus are one of the construction to realize a color electro-photographic apparatus which is small enough to be installed on a desk and has a high accurate transfer performance. The result of investigation on the legs will be described below, referring to FIG. 9 and FIG. 10.

Figure 9:
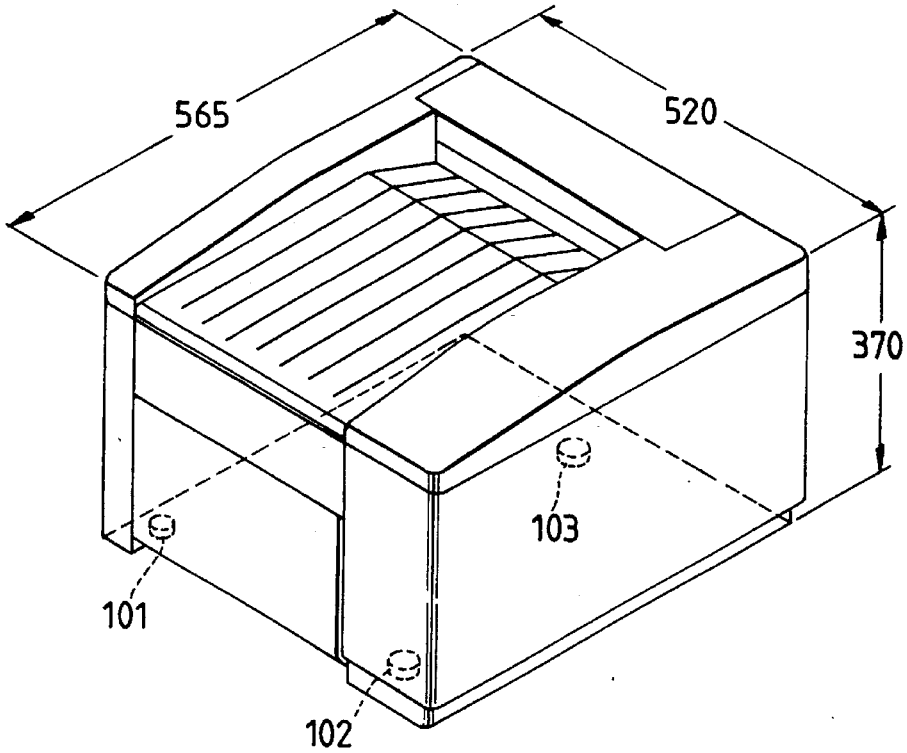
FIG. 9 is a perspective view illustrating a configuration of legs on the bottom of the apparatus.

FIG. 9 is a perspective view of a disk-top type color electro-photographic apparatus having three legs on the bottom of the body of apparatus. The embodiment of the color electro-photographic apparatus 1 is, as shown in the figure, 370 mm in height excluding its leg portion, 565 mm in width, 520 mm in depth and less than 50 kg in weight. Therefore, the apparatus can be carried and installed by two persons with ease.

The color electro-photographic apparatus 1 has a rear leg 103 on the bottom plate in the rear portion where the fixing unit 80 is installed and the weight of apparatus in the lateral direction is well balanced, and each of front legs 101 and 102 on the bottom plate in the each side of the front portion.

Therewith, the construction not to be affected by the unevenness of a desk can be realized as far as the body of the apparatus can support the weight of the color electro-photographic apparatus.

Figure 10:
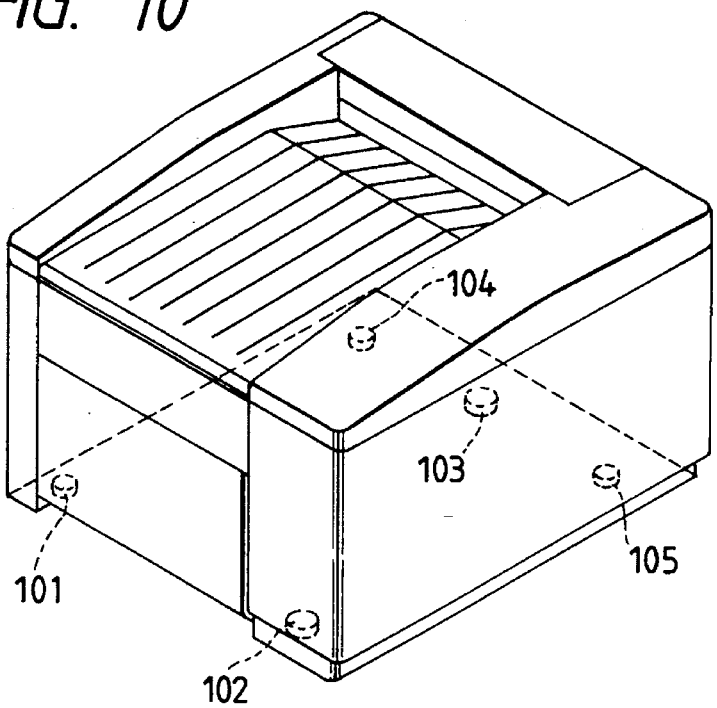
FIG. 10 is a perspective view illustrating another configuration of legs.

If a load acts on one of the sides in the rear portion of the color electro-photographic apparatus 1 having three legs, the body of apparatus is distorted until the bottom plate contact to the desk. In order to limit the deformation within a certain value, auxiliary legs 104 and 105 may be provided on the both sides in the rear portion as shown in FIG. 10 to form a five leg construction. Instead of adding the auxiliary legs 104 and 105, it is possible to limit the deformation by limiting the height of the three legs.

Figure 11:
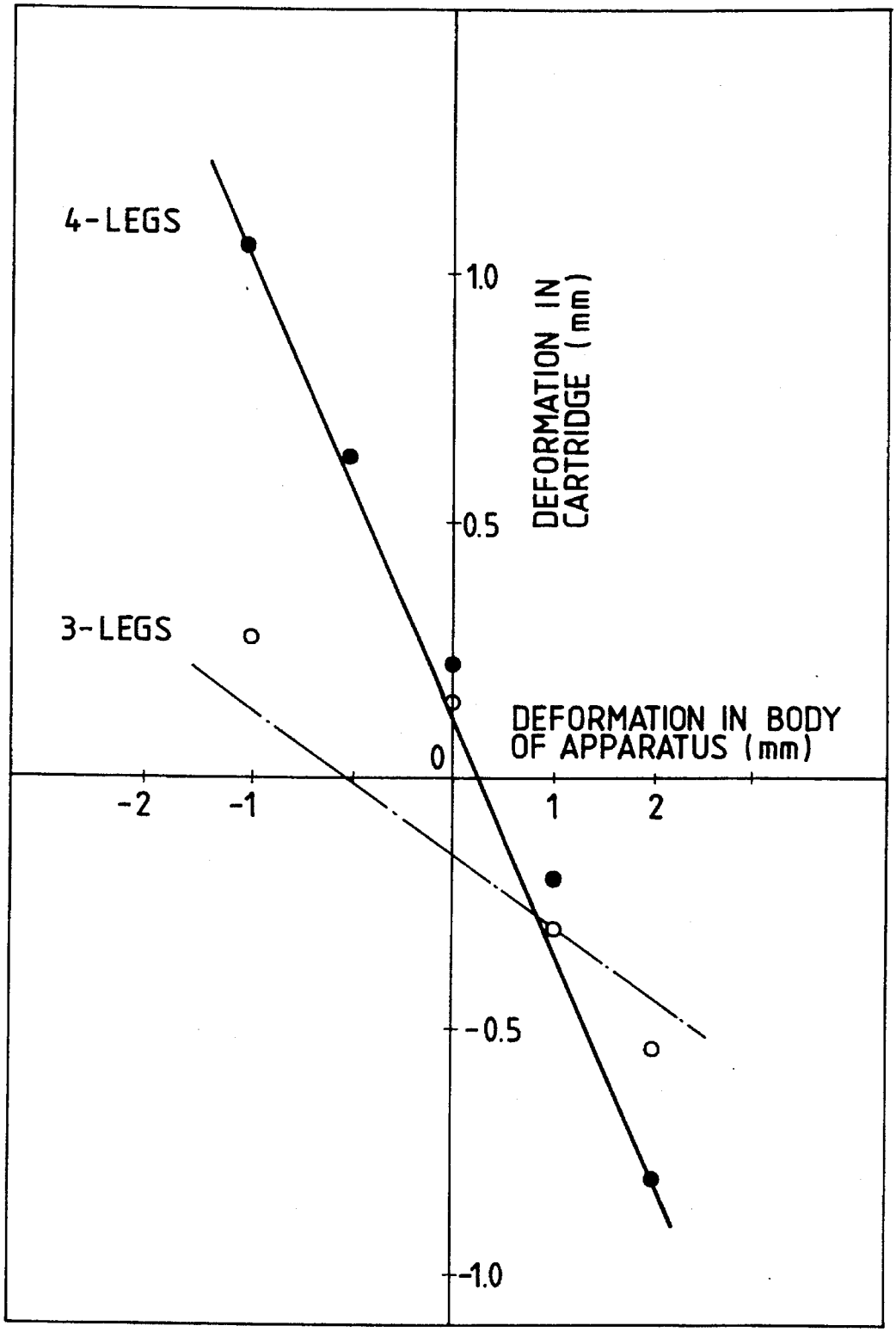
FIG. 11 is a graph showing the relationship between the deformation of a body of apparatus and the deformation of a cartridge.

FIG. 11 shows an experimental result on the deformation of the body of the color electro-photographic apparatus 1.

The ordinate indicates the deformation of the body of apparatus when the color electro-photographic apparatus 1 is installed on a desk having unevenness, and the abscissa indicates the deformation of the cartridge. In a conventional method providing four legs on the bottom plate, the deformation of the cartridge becomes approximately 1 mm providing that the unevenness of 2 mm in the desk causes the same amount of the deformation of the body of apparatus.

On the other hand, in the method of the embodiment providing three legs, the deformation of the cartridge becomes less than 0.5 mm when the unevenness of the desk is 2 mm. Therefore, the accuracy in the parallelism in each of the transfer drum 40, the drive pulley 10, the pulley A 11 and the pulley B 12 can be kept.

According to the embodiment, it is possible to obtain a desk-top type color electro=photographic apparatus which is small in size, light in weight, capable of performing color adjustment with high accuracy and user's maintenance.

Figure 12:
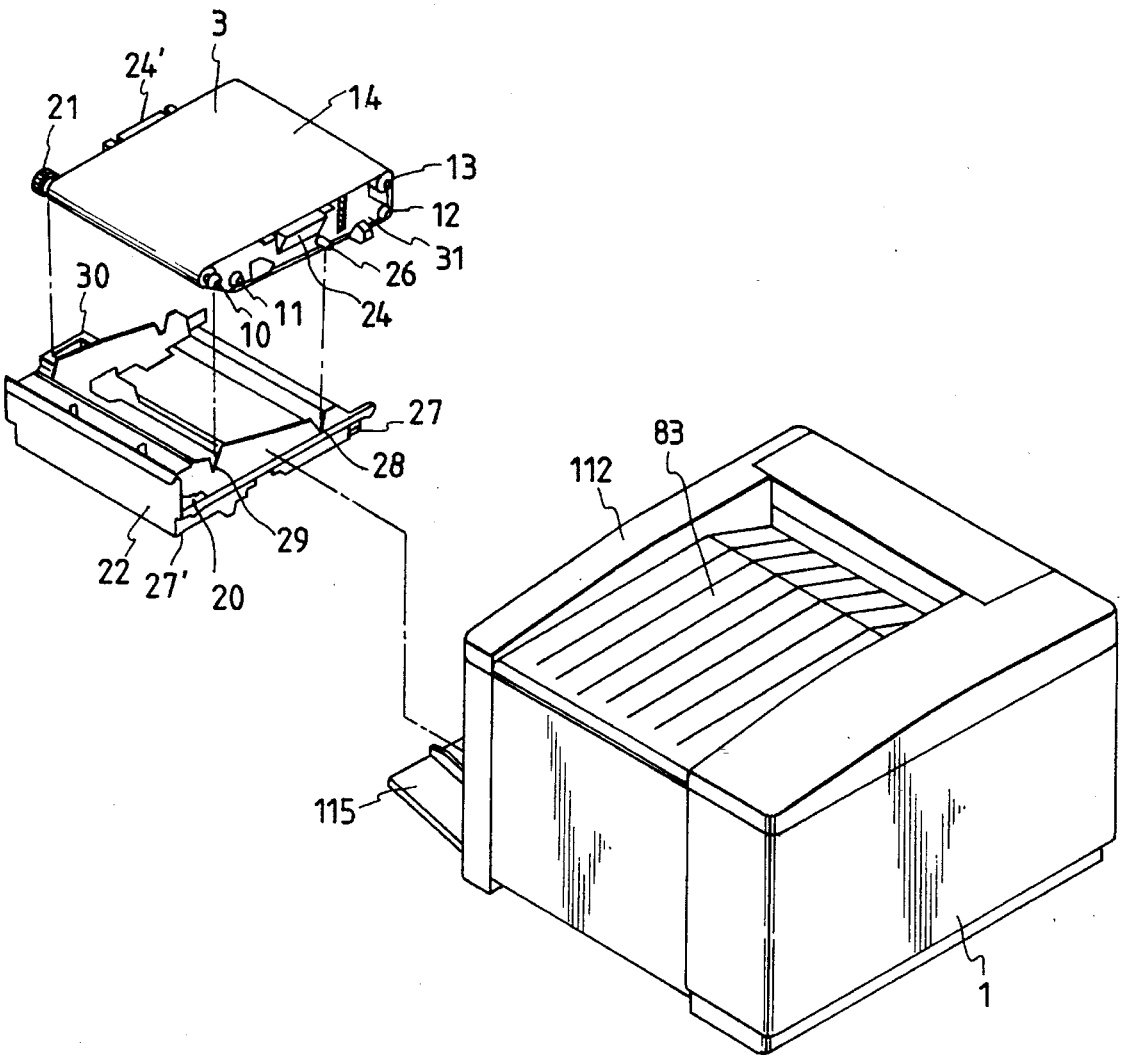
FIG. 12 is a perspective view illustrating another embodiment of mounting method of a cartridge on an apparatus.

Another embodiment according to the present invention will be described, referring to FIG. 12. In the embodiment, the cartridge 3 is mounted to the color electro-photographic apparatus 1 from the direction vertical to the direction of transferring printing medium in the apparatus. Therefore, a mounting opening is provided at the side of a cover 112 of the apparatus as shown in the figure.

The cartridge 3 is fastened to the cartridge holder 22 with the same way as described in the embodiment above. The cartridge holder 22 is entered into the color electro-photographic apparatus 1 through the mounting opening in the side of the cover 112. The photosensitive member 14 is carried by a user with holding the handles 24 and 24' and is inserted into the color electro-photographic apparatus 1 through the mounting opening while the holder guiding rails 27, 27' of the cartridge holder 22 are kept contacting with the guide rails provided in the apparatus and the handle 30 is turned up.

When the cartridge 3 touches to a stopper provided in the color electro-photographic apparatus 1 and does not go into further, the handle 30 is turned downward to fix the cartridge by hooking the hooks 20 to the pins 38, 38'. Then a cartridge cover B 115 is closed.

In the embodiment, since the cartridge is mounted to the color electro-photographic apparatus from the direction vertical to the direction of transferring printing medium in the apparatus, this type is effective in a case where it is difficult from the installation place of the apparatus that the cartridge cannot be mounted from the transferring direction of the printing medium. Therefore, by means of combining this with the embodiment described above, the direction of mounting cartridge can be arbitrarily changed according to the user's using direction of the apparatus.

According to the embodiment, it is possible to provide a color electro-photographic apparatus which is small in size, light in weight, capable of performing user's maintenance of the photosensitive member or the like and capable of obtaining a printing high in quality and less in displacement in colors.

Further, the apparatus can be installed and moved with ease and can be formed in a disk-top type since it is small and light.

Figure 13:
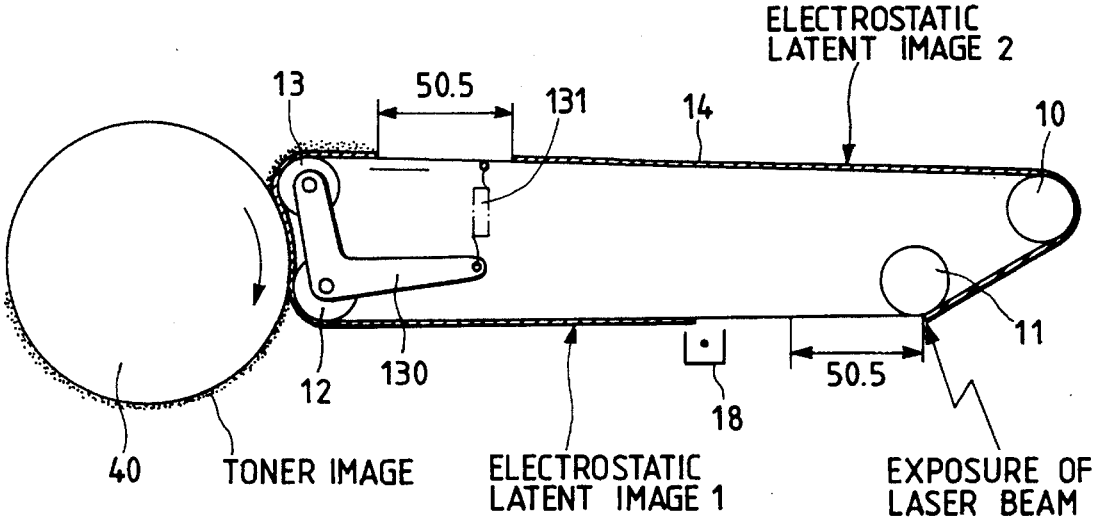
FIG. 13 is an enlarged cross-sectional view of a photosensitive member and a transfer drum part.

A further embodiment will be described below, referring to FIG. 13 to FIG. 18. FIG. 13 shows the relation between the photosensitive member 14 and the transfer drum 40.

The photosensitive member 14 wrapping four pulleys which are composed of a drive pulley 10 for driving the photosensitive member 14, a pulley A 11 for limiting the exposure position, a pulley B 12 for keeping the contacting width of the transfer drum 40 and the photosensitive member 14, and a tension pulley 13 for giving an initial tension to the photosensitive member 14. Each of the pulleys is rotatably supported with side plates of the cartridge 3. The tension pulley 13 is connected to the pulley 12 through rotatable links 130 having the same center of rotation as the shaft of the pulley 12, and is given an action of tension by means of acting tension force of sprig 131 on the link 130.

The other construction is the same as shown in FIG. 1.

In order to realize a high accurate color adjustment in such an apparatus, the photosensitive member 14 and the transfer drum 40 are required to be rotated with high accuracy. Therefore, the load in each of rotating parts needs to be decreased to decrease mechanical loss. Moreover, it is required to eliminate the displacement in colors caused by difference between the thermal expansion of the drive pulley driving the photosensitive member 14 and the thermal expansion of the transfer drum 40, caused by change in the thickness of toner layer depending on the variation of developing condition due to deterioration with age or environment change, and caused by change in the transmitting speed ratio from the photosensitive member 14 to the transfer drum 40 due to overlaying of toner.

The displacement in colors produced with the causes above can be decreased by means of calculating and controlling the transmitting speed ratio from the photosensitive member 14 to the transfer drum 40.

In an apparatus where a plurality of developing units 50, 52, 54 and 56 are provided for one photosensitive member 14, it is natural as an inevitable consequence to lengthen the distance between a laser exposing position where an electrostatic latent image is formed and a transfer position where a toner image on the photosensitive member 14 is transferred to the transfer drum 40. In a case where the rotating time of the transfer drum 40 is controlled with controlling the speed of the photosensitive member 14, it required that the electrostatic latent image is not affected by the speed variation of the photosensitive member 14.

Figure 14:
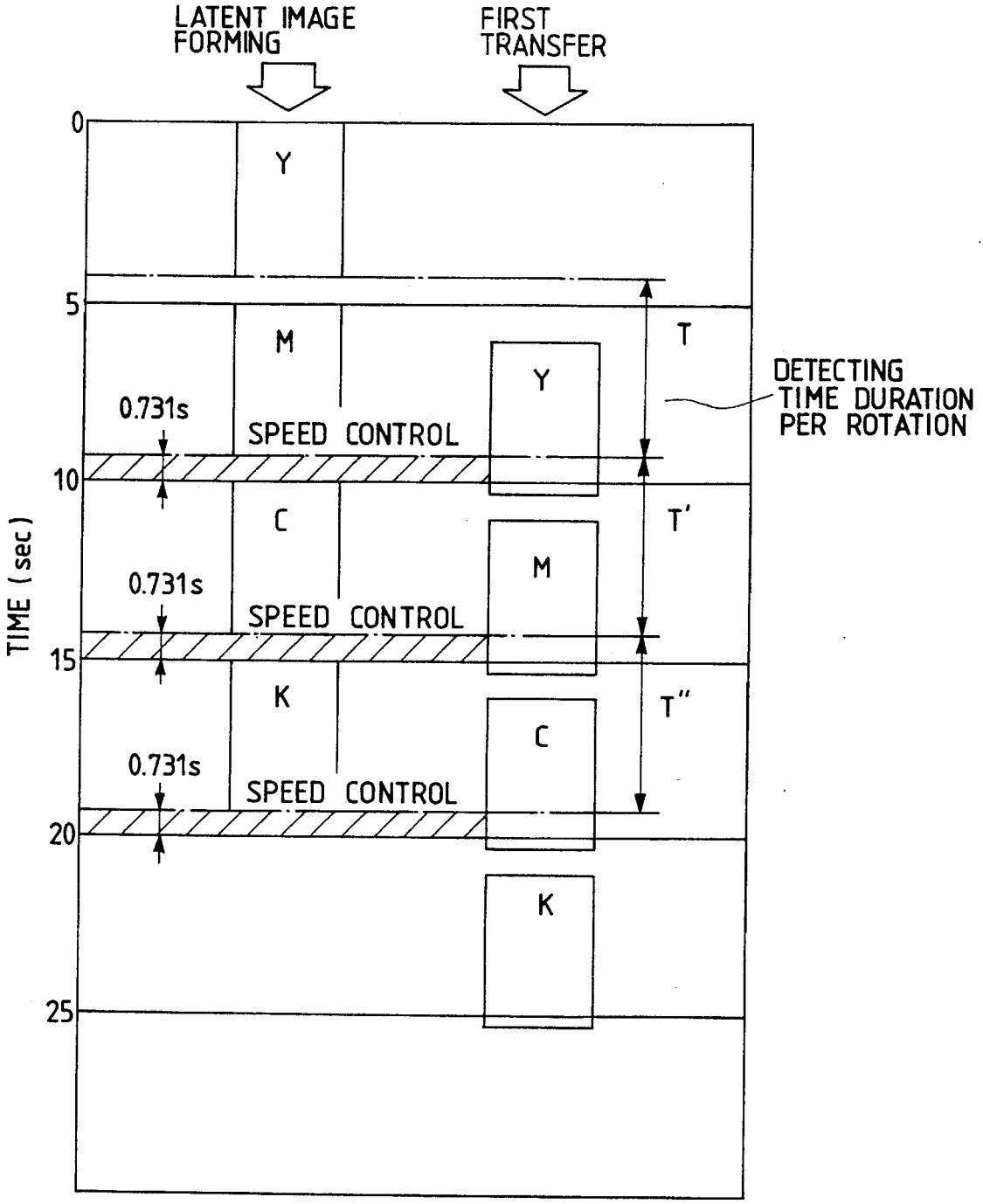
FIG. 14 is a chart explaining forming of electrostatic latent image and timing of transfer.

FIG. 14 shows the timing to form an electrostatic latent image at the laser exposing position and the timing to transfer a toner image on the photosensitive member 14 on the transfer drum 40 at the transfer position. FIG. 14 shows an example where a full color image is formed with speed of two pages per minute using four colors of yellow (Y), magenta (M), cyanic (C) and black (B), two electrostatic latent images for two colors having been exposed on the photosensitive member, non-exposed portion having width of 50.5 mm being provided between the latent images, the photosensitive member 14 moving this distance in 0.731 seconds.

The time duration for one rotation of the transfer drum 40 is measured with high accuracy, while the toner image for yellow color, that is, first transfer color is being transferred and the electrostatic latent image for magenta color is being printed. The timing of the first transfer for transferring a toner image on the photosensitive member 14 to the transfer drum 40 is shifted backward from the completion of forming the electrostatic latent image by a certain time. For instance, the timing for transferring a yellow toner image to the transfer drum is performed a little later than the completion of forming the electrostatic latent image for yellow color. Therefore, the timing to measure the time duration for one rotation of the transfer drum 40 is approximately during the electrostatic latent image for magenta color being printed as shown in FIG. 14. The same effect can be obtained by measuring the speed variation of the transfer drum 40. Then, the time duration for one rotation of the transfer drum 40 is measured with high accuracy, while the toner image for magenta color is being transferred and the electrostatic latent image for cyanic color is being printed, and is also measured while the toner image for cyanic color is being transferred and the electrostatic latent image for black color is being printed.

The speed of the photosensitive member 14 is controlled while the gap having width of 50.5mm between the electrostatic latent images is passing by the laser exposing position such that superposing of colors is kept in a good condition by means of correcting a base time $T_0$ using the result of measurement.

Figure 15:
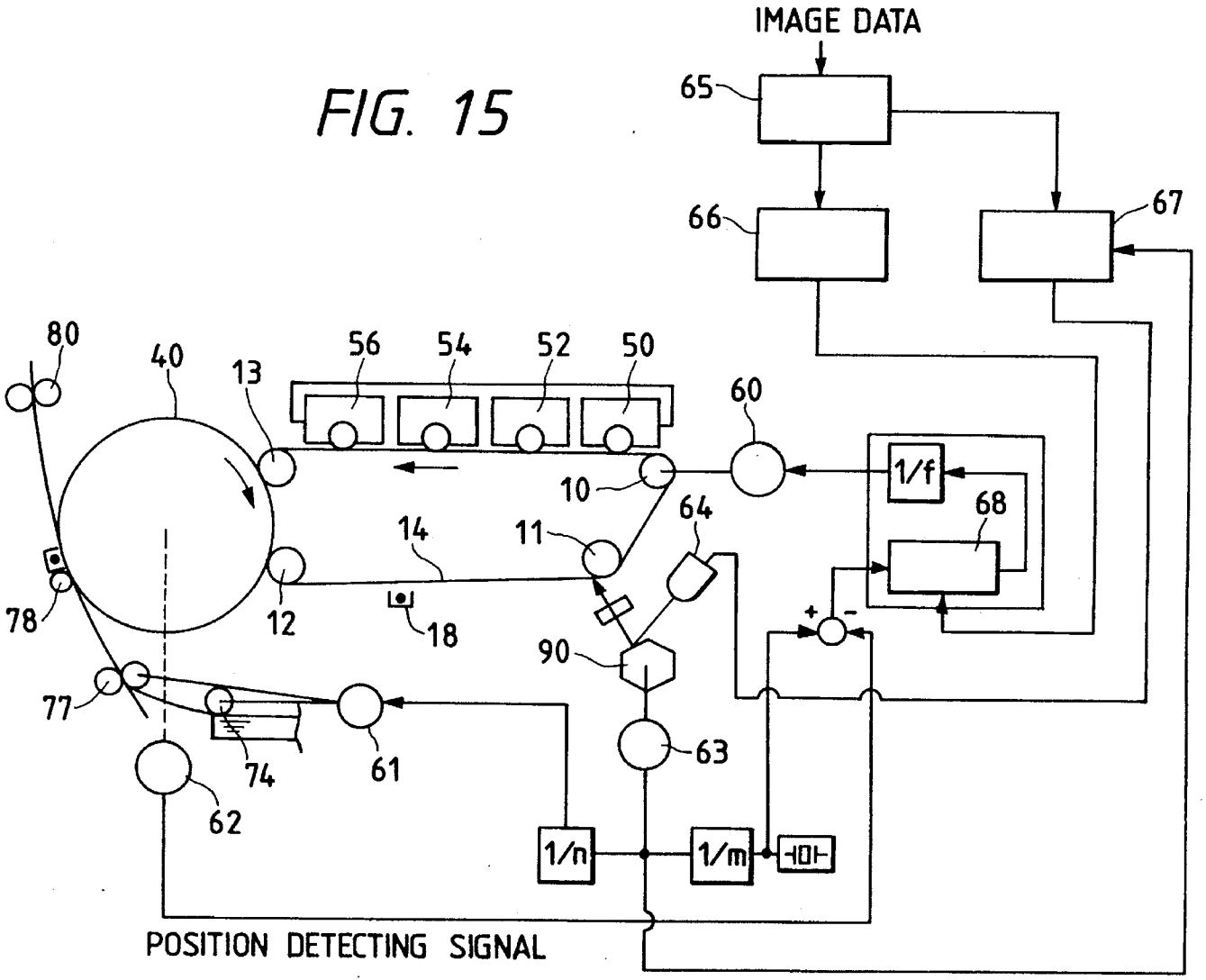
FIG. 15 is a block diagram illustrating speed control.

When a toner image is transferred on the transfer drum 40, the outer diameter of the transfer drum 40 increases by the thickness of the toner layer. A ratio of area occupied by a toner image or a length of an image in the rotating direction of the photosensitive member 14 is calculated in advance using an image data transmitted from an information processing unit which is not shown in the figure, the rotating speed of the transfer drum 40 during forming the image being determined before forming the electrostatic latent image corresponding to the image, the speed of the photosensitive member 14 being controlled using the result. FIG. 15 is a block diagram illustrating speed control.

A color image data is divided into four image data for four colors, yellow, magenta, cyanic and black, each of the image data being transmitted to the printer one after another. The image data is converted into a pixel data by a pixel data forming means 65. Lightening of a laser source 64 in the exposing unit 2 is controlled with an exposing control means 67 based on the pixel data, the laser beam is irradiated to a polygon mirror 90 rotating at a constant speed driven by a scanner motor 63 in the exposing unit 2. At the same time, the ratio of area occupied by a toner image or the length of an image is calculated based on the image data, the correction value being determined by a speed correction value calculating means 66, a CPU 68 controlling the speed of a belt motor 60 to determine the speed of the photosensitive member 14. Further, for the third and the fourth colors, an encoder 62 measuring the rotating cycle of the transfer drum 40 during the first transferring for the precedent color, the result being compared with the base rotating time $T_0$ to control transferring of the photosensitive member 14 with high accuracy.

Displacement in colors is produced by the difference caused by change in the rotating cycle of the transfer drum 40 due to attaching toner to an electrostatic latent image corresponding to an image data. The speed value for the photosensitive member 14 is set such that the displacement in colors may be corrected for the one rotation of the transfer drum. In other words, the transfer drum 40 is rotated in $T_0$ seconds per one rotation with high accuracy when each color of toner images is transferred on the transfer drum 40.

By performing the control for each of colors, it can be realized that the transfer drum is rotated at a speed of $T_0$ seconds per one rotation with high accuracy even when there is toner between the transfer drum 40 and the photosensitive member 14.

Figure 16:
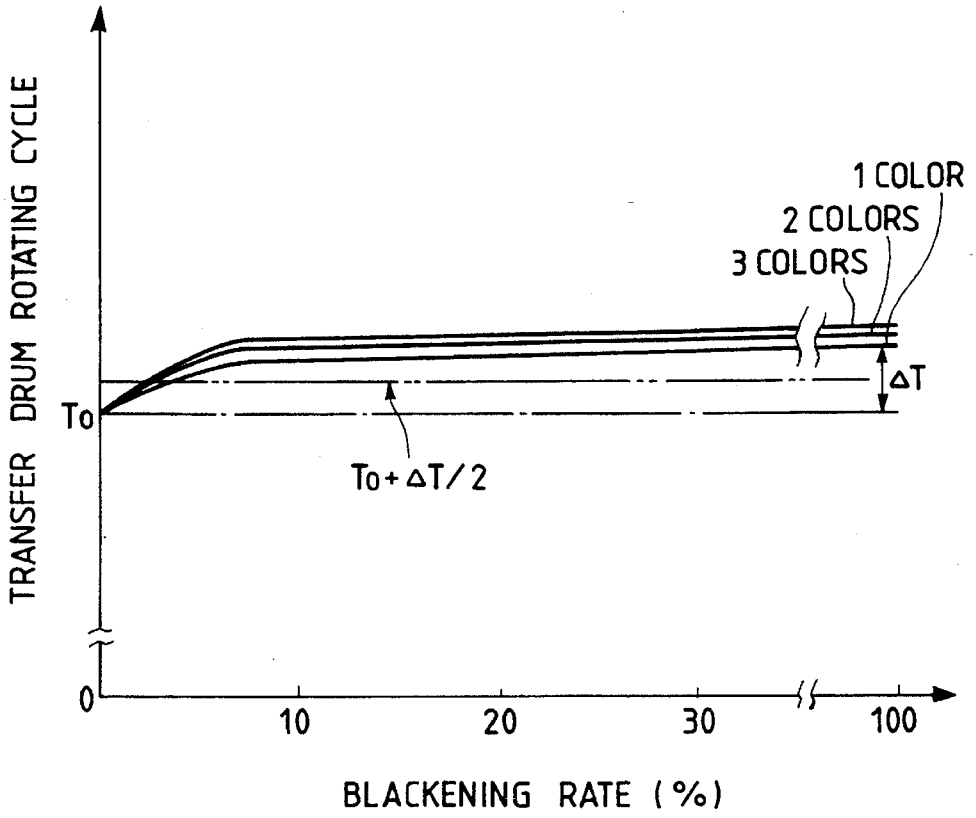
FIG. 16 is a graph showing the relationship between toner image area and transfer drum rotating cycle.
Figure 17:
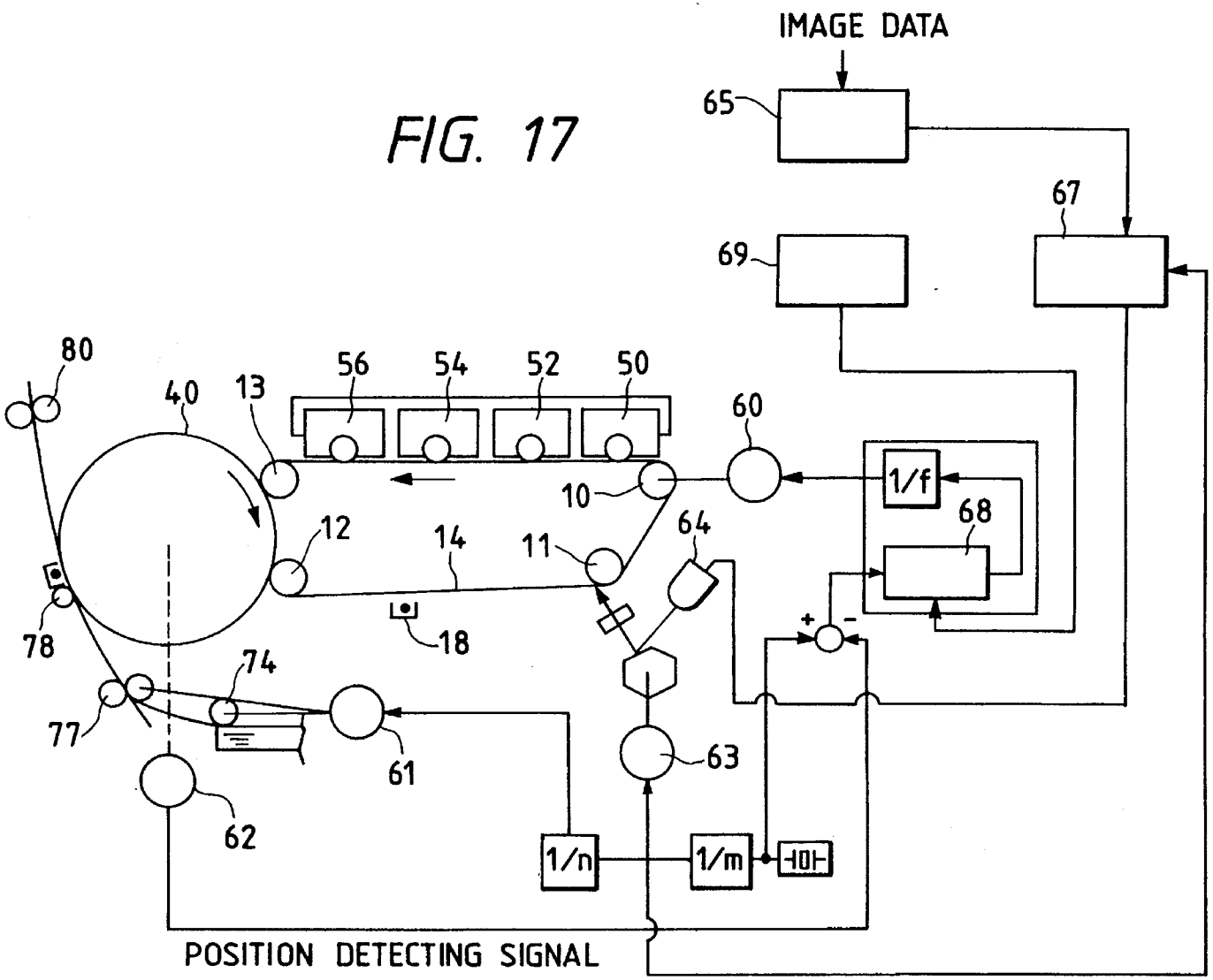
FIG. 17 is a block diagram illustrating speed control.

It is revealed with an experiment that the change in the rotating cycle of the transfer drum 40 due to existence of toner layer becomes saturated as the ratio of area occupied by toner image, that is, the blackening rate becomes large as shown in FIG. 16, the saturated values being comparatively small, decreasing the change in the cycle to one-half satisfying the performance for practical use. Therefore, the desirable performance can be attained by adding the correction value $\Delta T/2$ set in advance to the rotating time (rotating cycle) of the transfer drum 40 without toner layer, that is, the base time duration $T_0$. Where $\Delta T$ is difference between the cycle at the saturated condition and the cycle without toner layer. In this occasion, the rotating cycle of the transfer drum 40 in the speed command is $T_0 + \Delta T/2$. FIG. 17 shows an embodiment of speed control means. In this embodiment, the speed control of the photosensitive member 14 is performed with the fixed correction values from a correction value storing means 69 for printing the electrostatic latent images for the second color, the third color and the fourth color.

Figure 18:
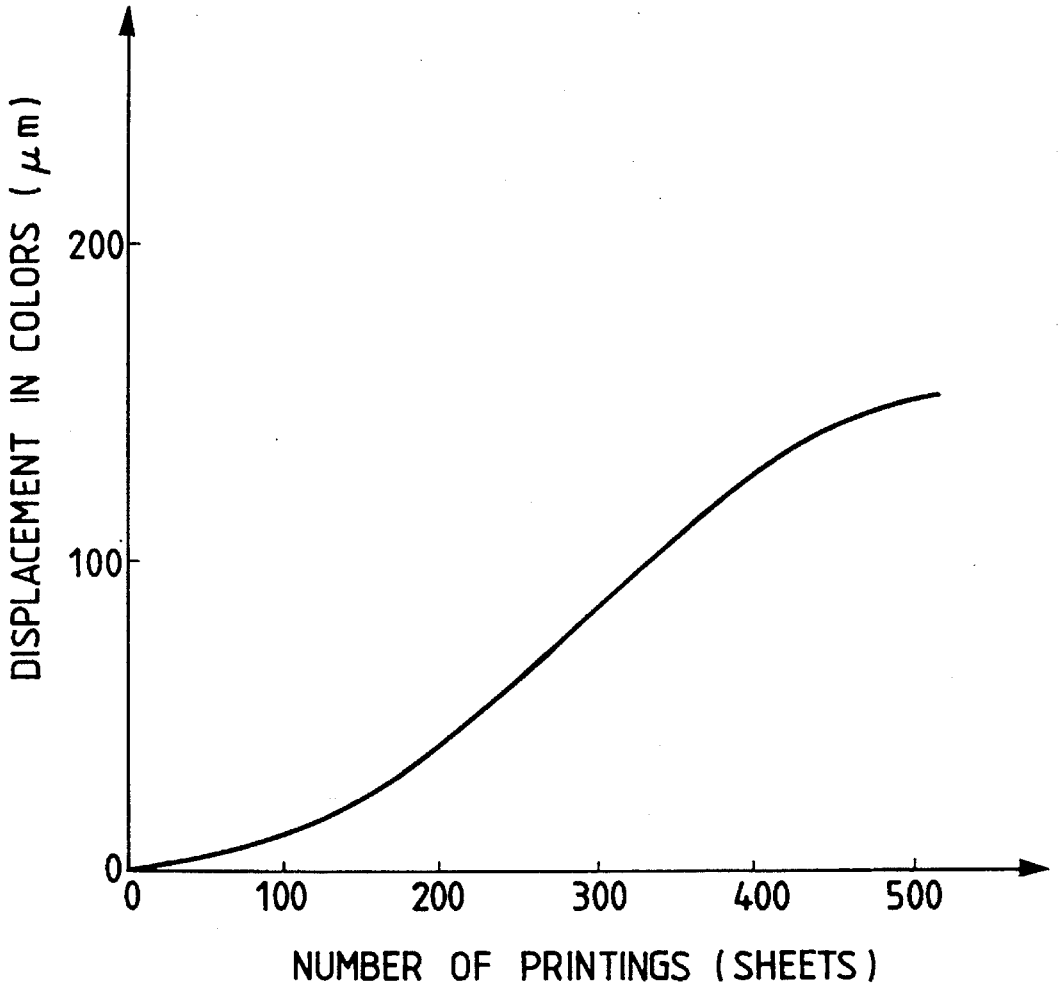
FIG. 18 is a graph showing the relationship between number of printing and displacement in colors.

Besides the change in the rotating cycle of the transfer drum 40 due to the toner layer described above, displacement in colors is caused by the slow change in the base speed due to thermal deformation of the transfer drum 40 or the photosensitive member 14. FIG. 18 shows an example where the displacement in colors increases as the number of printing sheets increases due to thermal deformation of the drive pulley 10.

By using the method of measuring change in rotating cycle of the transfer drum 40 during one page printing in order to correct such displacement in colors, the change cannot be measured with sufficient accuracy because of too small change. The change in the rotating cycle of the transfer drum 40 between a page and the following page is less that 1 ms.

Therefore, the rotating cycle of the transfer drum 40 for the first color in each of pages is measured, each of the rotating cycles being compared with the base time at starting of operation, the change being corrected when the difference exceeds an allowable range, the speed of the photosensitive member 14 being controlled to correct the displacement in colors.

The base time may be set at the initial setting time of the apparatus, before the beginning of printing, or at the printing of the first color. In these cases, the same effect can be attained.

According to the embodiment, printing which is small in displacement in colors and high in quality can be attained with a simple construction.

What is claimed is:

1. A color electro-photographic apparatus having a endless-belt-shaped photosensitive member for forming an electrostatic latent images on it by exposure, developing means for forming toner images from the electro-static latent images formed on the photosensitive member, a transfer member for transferring the toner images, wherein:

the endless-belt-shaped photosensitive member is laterally stretched to form approximately an oval shape such as to touch with each of the developing means;

the endless belt and the transfer member being placed laterally such that the edge surface in the major axis side of the endless belt touches with the transfer member;

the endless-belt-shaped photosensitive member being stretched with wrapping more than three pulleys;

all the pulleys except the pulley giving tension to the endless-belt-shaped photosensitive member having an identical outer diameter;

the outer diameter having an integer ratio of the diameter of the transfer member and an accuracy less than 0.5%.

2. A color electro-photographic apparatus according to claim 1, wherein:

a plurality of developing means are provided;

a plurality of said developing means being placed in a single rank;

the endless-belt-shaped photosensitive member being placed under the plural developing means.

3. A color electro-photographic apparatus according to claim 1, which comprises:

three legs on the bottom of the color electro-photographic apparatus to set the apparatus on a desk.

4. A color electro-photographic apparatus according to claim 1, wherein:

the height of the body of apparatus is less than 370 mm.

5. A color electro-photographic apparatus according to claim 1, wherein:

the weight of the apparatus is less than 50 kg.

6. A color electro-photographic apparatus having a endless-belt-shaped photosensitive member for forming an electrostatic latent images on it by exposure, developing means for forming toner images from the electro-static latent images formed on the photosensitive member, a transfer member for transferring the .toner images, wherein:

the developing means for four colors are individually placed in a single line in the lateral direction;

the color electro-photographic apparatus further comprising means for measuring one rotation time of the transfer member when the toner image on the transfer member is transferred, comparing means for comparing the one rotation time of the transfer member with the base time between electrostatic latent images for individual color images printed on the photosensitive belt, and registration control means for controlling the moving speed of the photosensitive member during printing the electrostatic latent images on the photosensitive member based on the output of the comparing means.

7. A color electro-photographic apparatus according to claim 6, wherein:

the registration control means measures one rotation time of the transfer member when a first color toner image is transferred on the transfer member, comparing the one rotation time of the transfer member with the base time, controlling the moving speed of the photosensitive member during printing the imaged electrostatic latent image on the photosensitive member for a first color in the next page.

8. A color electro-photographic apparatus according to claim 6, wherein:

the registration control means measures one rotation time of the transfer member during transferring a first color toner image to the transfer member and controls the moving speed of the photosensitive member during printing electrostatic latent images for all the color of or for the combination among a second, a third and a fourth colors on the photosensitive member.

9. A color electro-photographic apparatus according to claim 6, which comprises:

three legs on the bottom of the color electro-photographic apparatus to set the apparatus on a desk.

10. A color electro-photographic apparatus according to claim 6, wherein:

the height of the body of apparatus is less than 370 mm.

11. A color electro-photographic apparatus according to claim 6, wherein:

the weight of the apparatus is less than 50 kg.

* * * * *